US005487214A

United States Patent [19]

Walters

[11] Patent Number: 5,487,214

[45] Date of Patent: Jan. 30, 1996

[54] METHOD OF MAKING A MONOLITHIC MAGNETIC DEVICE WITH PRINTED CIRCUIT INTERCONNECTIONS

[75] Inventor: Michael M. Walters, Endwell, N.Y.

[73] Assignee: International Business Machines Corp., Armonk, N.Y.

[21] Appl. No.: 958,878

[22] Filed: Oct. 9, 1992

Related U.S. Application Data

[62] Division of Ser. No. 727,675, Jul. 10, 1991, abandoned.

[51] Int. Cl.[6] ..... H01F 41/06

[52] U.S. Cl. ..... 29/602.1; 336/200; 427/96; 427/116

[58] Field of Search ..... 29/602.1, 605; 336/200; 427/96, 116, 127

[56] References Cited

U.S. PATENT DOCUMENTS 3,185,947 5/1965 Freymodsson ..... 29/602.1 X 4,253,231 3/1981 Nouet ..... 29/602.1

4,522,671 6/1985 Grunwald et al. ..... 29/602.14

*Primary Examiner*—Carl E. Hall

*Attorney, Agent, or Firm*—Eugene I. Shkurko; William H. Steinberg

[57] ABSTRACT

A monolithic magnetic device having a plurality of transformer elements having single turn primaries and single turn secondaries fabricated on a plate of ferrite which has the outline of a ceramic leadless chip carrier. Each of the magnetic elements has a primary winding formed from a copper via plated on the ferrite. Each element's secondary is another copper via plated over an insulating layer formed over the first layer of copper. The elements' primaries are interconnected on the first copper layer and the elements' secondaries are interconnected on the second copper layer. The configuration and turns ratio of the transformer are determined by the series and or parallel interconnections of the primary and secondaries. Some of the interconnections can be provided by the next higher assembly level through the circuit card, with the same magnetic device providing many turns ratio combinations or values of inductors.

7 Claims, 3 Drawing Sheets

METHOD OF MAKING A MONOLITHIC MAGNETIC DEVICE WITH PRINTED CIRCUIT INTERCONNECTIONS

This application is a divisional application of patent application Ser. No. 727,675 filed Jul. 10, 1991, now abandoned.

BACKGROUND OF THE INVENTION

The present invention relates to magnetic devices, such as transformers and inductors, that can be assembled using automated equipment, and surface mounted as other electronic components on circuit cards.

The magnetic components used in power technology do not lend themselves to automated assembly and are therefore expensive to fabricate. Power transformers and output inductors are massive devices which require multiple manual assembly operations.

Power processors have been evolving from large, bulky, central power supplies toward modular, low profile, distributed power supplies. While memory, digital processor, and I/O pages are assembled using automated handling procedures, the power supply components have unique shapes that do not conform to automated handling equipment. The magnetic components of the power supply are particularly troublesome in this regard. Standard magnetic fabrication techniques are better suited for devices that have a cubic or high profile outlines. Automatic handling equipment requires low profile components typically less than 0.2 inches.

One way of reducing the profile of conventional transformers is to use planar construction techniques. The planar transformer has the winding etched on a printed circuit board and sandwiched between core pieces. Standard planar transformers are available with profiles as low as 0.325 inch. There is an optimum profile for the maximum power density of planar pot core transformers. At profiles below the optimum, the power density decreases rapidly, due to the thickness of the circuit board material, making it difficult to fabricate a planar transformer having a thickness less than 0.1 inches.

It is an object of the present invention to provide a low profile magnetic device that is compatible with automated assembly equipment.

It is another object of the present invention to provide magnetic devices that can be placed on circuit cards and surface mounted the same way as electronic components.

It is a further object of the present invention to provide a reconfigurable and expandable transformer that is compatible with automated assembly equipment.

SUMMARY OF THE INVENTION

In one aspect of the present invention, a transformer which can be surface mounted is provided. The transformer has a plate of flux permeable, substantially noncurrent conducting material. A first layer of electrical current conductive material extends between faces of the plate and forms a first single turn winding. An electrically insulating layer covers the first layer of electrical current conductive material. A second layer of electrical current conductive material covers the insulating layer between faces of the plate and forms a second single turn winding. Means for electrically connecting to the first layer of conductive material is provided, as well as means for electrically connecting to the second layer of conductive material.

In another aspect of the present invention a method of fabricating a magnetic device for surface mounting on a circuit board is provided. A plurality of holes are formed through a plate of flux permeable material. A first layer of current conductive material is plated in the holes to form a plurality of first windings. A first layer of current conductive material is plated on both sides of the plate with a pattern which interconnects at least a portion of the plurality of first windings. A first layer of current conductive material is also formed on several regions of the plate for use in surface mounting. Each of the regions is connected to at least a portion of the first windings. The first layer of current conductive material is covered with an insulating layer. A second layer of current conductive material is plated in the holes on the insulating layer to form a plurality of second windings. The second layer is plated on both sides of the plate with a pattern which interconnects at least a portion of the plurality of second windings. A second layer of current conductive material is also formed on several regions on the plate for use in surface mounting. Each of the regions connected to at least a portion of the second windings.

DETAILED DESCRIPTION OF THE INVENTION

Figure 1A:
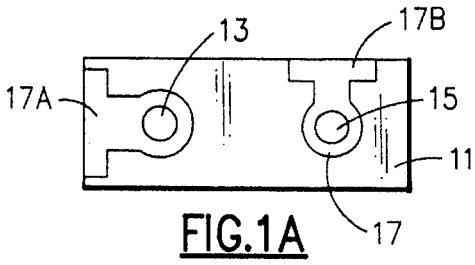
FIGS. 1A and 1B are plan views of the bottom and top side, respectively, of a plate of ferrite material with a pattern of conductive material on each side, for forming a dual element magnetic/device in accordance with the present invention.

Referring now to the drawing wherein like numeral indicate like elements throughout, and particularly FIGS.

Figure 1B:
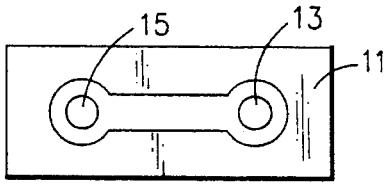
Figure 2:
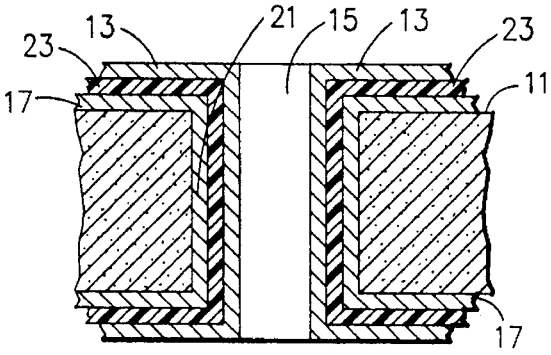
FIG. 2 is a partial sectional view along the lines 2—2 of FIG. 1D.

1A, 1B, 1C, and 1D thereof, a single plate of magnetic flux permeable, high electrical resistance material, such as ferrite 11, is shown. A pair of single turn primary, single turn secondary, transformer elements are formed on the ferrite plate 11 by providing two holes 13 and 15 extending through the ferrite plate. The holes allow access to regions between the two major faces of the ferrite plate. A coating of electrically conductive material, such as copper, is plated on the bottom and top of the plate with the pattern shown in FIGS. 1A and 1B, respectively, using printed circuit technology. The pattern 17 on the bottom of the plate provides a separate conductive pattern around each of the holes and extends to the edge of the plate to form interconnect regions 17A and 17B. The pattern on the top of the plate 19 surrounds each of the holes and connects the regions around each of the holes together. The wall of each of the holes is plated with the same electrically conductive material and serves as vias 21 connecting plated areas surrounding the holes at the top and bottom of the plate. This first layer of conductive plating provides the primary winding of the transformer element. A layer of electrically insulating material 23, such as Parylene C, is deposited on the plated conductive material including the vias. Paraylene is a generic name for members of a thermoplastic polymer series of which a basic member is poly-para-xylylene and is available from the Union Carbide Corporation. The dielectric layer can be seen in FIG. 2.

Figure 1C:
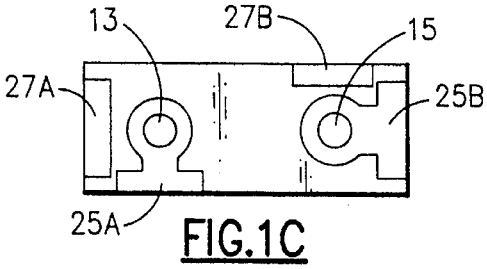
FIGS. 1C and 1D are plan views of the bottom and top side, respectively, of FIGS. 1A and 1B covered with a layer of dielectric material and a pattern of conductive material on each side, for forming a dual element magnetic device in accordance with the present invention.
Figure 1D:
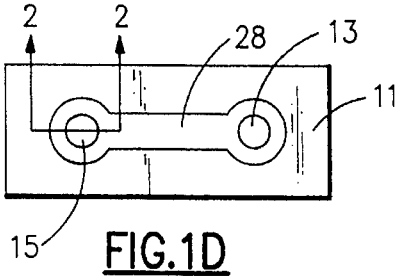
Figure 3:
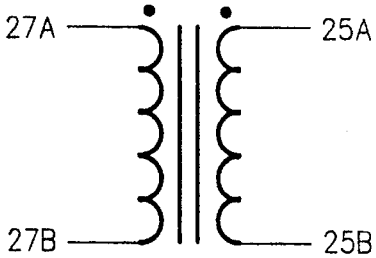
FIG. 3 is a schematic diagram showing how the terminals of the magnetic device of FIG. 1 can be interconnected to form a 1 to 1 turn ratio transformer.
Figure 4:
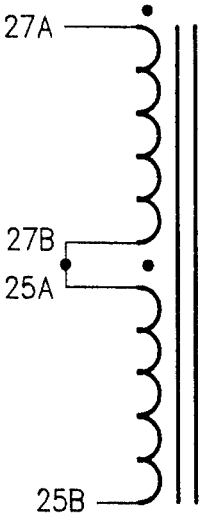
FIG. 4 is a schematic diagram showing how the terminals of the magnetic device of FIG. 1 can be interconnected to form an inductor.

A second layer of electrical current conductive material, such as copper is plated on the bottom and top of the insulating material including the vias, with the portion plated in the vias forming the transformer element secondary as shown in FIGS. 1C and 1D. The pattern of conductive material on the bottom of the plate again surrounds the holes but is brought out to different locations at the edge of the plate to form termination regions 25A and 25B to provide contacts for surface mounting. The termination regions 25A and 25B do not align with the interconnect regions 17A and 17B of the first copper layer. Termination regions 27A and 27B are provided, which are aligned with the interconnect regions 17A and 17B, respectively, of the first layer of conductive material. The pattern of the conductive material on the top of the plate 28 connects the area around the holes to one another. When transformer elements are connected as shown in FIG. 3 with the terminations 27A and 27B used as the leads to the primary winding of a transformer and terminations 25A and 25B used as the leads to the secondary, a one to one turns ratio transformer is formed. In operation, the two windings of the transformer are on the same highly permeable material 11 and are linked by essentially the same magnetic flux. A changing voltage applied to one of the windings causes a change of current to flow, thus creating a changing magnetic flux in the permeable material. Because of the changing flux, voltage is induced in the other winding. However, if one of the primary winding leads is connected in series with one of the secondary winding leads as shown in FIG. 4, then an inductor is formed. An inductor can also be formed by connecting the primary and secondary windings in parallel.

The hole size used should be as small as possible, with the metallization and insulation layers filling the hole. Transformers, no matter how fabricated, have structures serving as winding and cores. The maximum power density (measured as watts per cubic inch or watts per pound) is achieved when the final device has the minimum amount of voids in the device's volume, since any voids do not contribute to the transformer function. Filling voids with more or larger windings reduces the device's power dissipation.

In a monolithic transformer with two metallization layers, where copper losses dictate 0.002 inches of copper be deposited for each metallization layers and 0.001 inches of insulation is required to achieve primary to secondary insulation, the diameter of the hole in a ferrite plate must be greater than twice the thickness of each of the layers ($2\times0.002+2\times0.001+2\times0.002=0.01$ inches). Electroplated copper tends to build up at the hole openings and thin down in the middle of the hole. The deposition process used, the acceptable yield, together with the minimum thickness required in the layers, will determine the hole size needed.

Referring now to FIGS. 5A, 5B, 5C, and 5D, a single plate of magnetic flux permeable, high electrical resistance material, such as ferrite 11, is shown. A pair of single turn primary, single turn secondary, transformer elements are formed on the ferrite plate 11 by using a portion of the region extending between the major faces of the plate, which are located at the edge of the plate. A coating of electrically conductive material, such as copper, is plated on the bottom and top of the plate with the pattern shown in FIGS. 5A and 5B, respectively, using printed circuit technology. The pattern on the bottom of the plate provides a separate conductive pattern adjacent each of the plated regions between the major faces of the plate to form interconnect regions 29A and 29B. The pattern on the top of the plate 30 is adjacent each of the regions between the major faces and connects the regions adjacent each of the plated edge portions together. The edge of each of the regions between the major faces is plated with the same electrically conductive material and serves as vias 31 connecting plated areas adjacent the region between the major faces of the plate at the top and bottom of the plate. This first layer of conductive plating extending between the major faces of the plate provides the primary winding of the transformer element. A layer of electrically insulating material, such as Parylene C, is deposited on the plated conductive material, as was shown in FIG. 2.

Figure 5A:
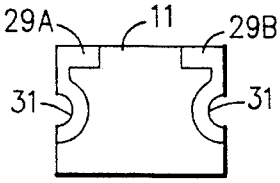
FIGS. 5A and 5B are plan views of the bottom and top side, respectively, of a plate of ferrite material with a pattern of conductive material on each side, for forming a dual element magnetic device in accordance with the present invention.
Figure 5C:
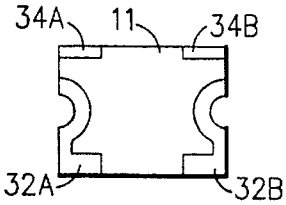
FIGS. 5C and 5D are plan views of the bottom and top side, respectively, of FIGS. 5A and 5B covered with a layer of dielectric material and a pattern of conductive material on each side, for forming a dual element magnetic device in accordance with the present invention.
Figure 5B:
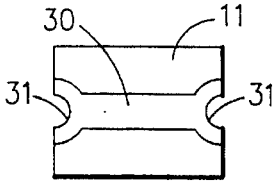
Figure 5D:
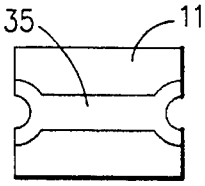

A second layer of electrical current conductive material, such as copper is plated on the bottom and top of the insulating material with the portion extending between the major faces forming the transformer element secondary as shown in FIGS. 5C and 5D. The pattern of conductive material on the bottom of the plate is adjacent to the plated regions between the major faces but is brought out to different locations at the edge of the plate to form termination regions 32A and 32B to provide contacts for surface mounting. The termination regions 32A and 32B do not align with the interconnect regions 29A and 29B of the first copper layer. Termination regions 34A and 34B are provided, which are aligned with the interconnect regions 29A and 29B, respectively, of the first layer of conductive material. The pattern of the conductive material 35 on the top of the plate connects the area around the plated regions between the major surfaces of the plate to one another. This device can be connected as a transformer or an inductor as discussed in connection with FIG. 1.

A multiple element magnetic device which can be configured as a transformer with different turns ratios or arranged as multiple transformers is shown in FIGS. 6A, 6B, 6C, and 6D. The multiple element device has a single plate of magnetic flux permeable, high electrical resistance material 36, such as ferrite, conforming to the outline of a ceramic leadless chip carrier having dimensions of 0.35 inches by 0.35 inches by 0.1 inches ,for example, and a plurality of indentations 37 about the perimeter to provide surface solder connection to a printed circuit board . The leadless chip carrier outline has an index corner 38 for orientation. purposes. Ceramic leadless chip carriers come in a variety of sizes and different sizes can be used depending on the number of elements and the power capability desired. A plurality of single turn primary, single turn secondary, transformer elements are located on the ferrite plate, with sixteen elements shown in the embodiment of FIG. 6. As described in connection with FIG. 1, each of the transformer elements shown in FIG. 6 includes a hole 39, extending through the ferrite plate. A coating of electrically conductive material, such as copper, is plated on the bottom and top of the plate with the pattern 41 and 43 shown in FIGS. 6A and 6B, respectively, using printed circuit technology. The pattern on the top of the plate 43 surrounds each of the holes and together with pattern on the bottom of the plate and plating on the interior walls of the holes connects the sixteen elements in series. The pattern on the bottom of the plate 41 provides a conductive pattern around each of the holes and extends the conductive pattern to the edge of the chip to form interconnect regions 41A and 41B for the first and last element in the series connection of the elements. The plated holes 39 serve as vias connecting plated areas surrounding the holes at the top and bottom of the plate. The first layer of conductive plating in the hole provides the primary winding of the transformer element. A layer of electrically insulating material, such as Parylene C thermoplastic polymer, is deposited on the plated conductive material including the vias, as was discussed in connection with FIG. 2.

Figure 6A:
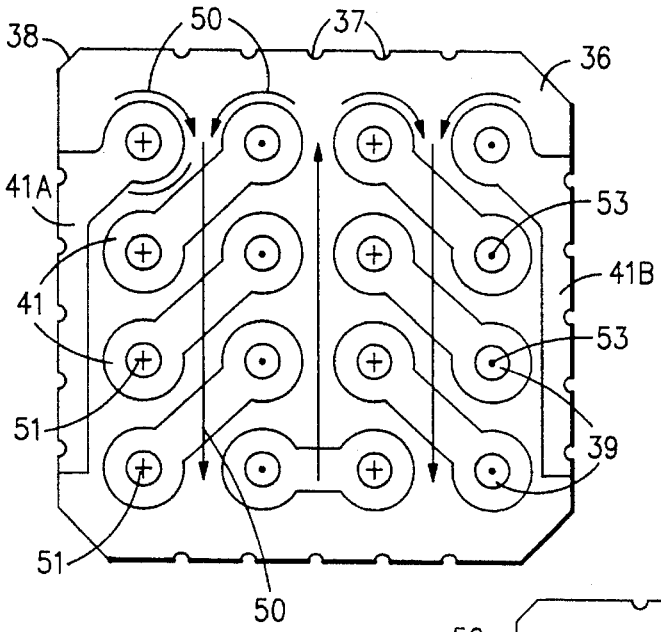
FIGS. 6A and 6B are plan views of the bottom and top side, respectively, of a plate of ferrite material with a first pattern of conductive material on each side.
Figure 6B:
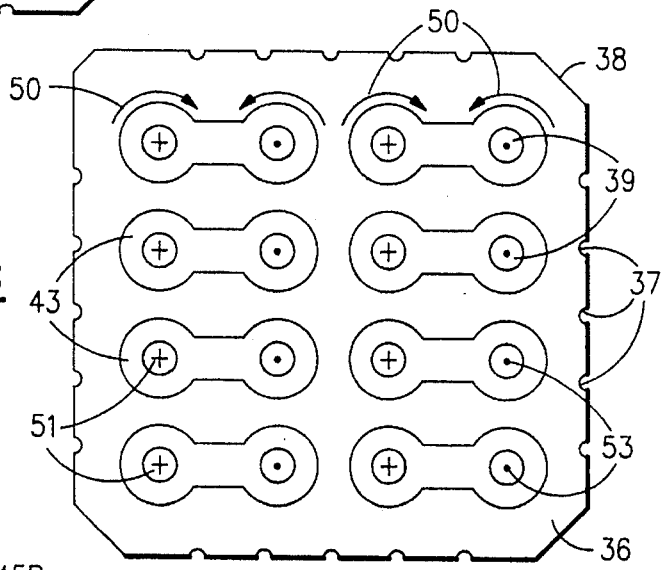
Figure 6C:
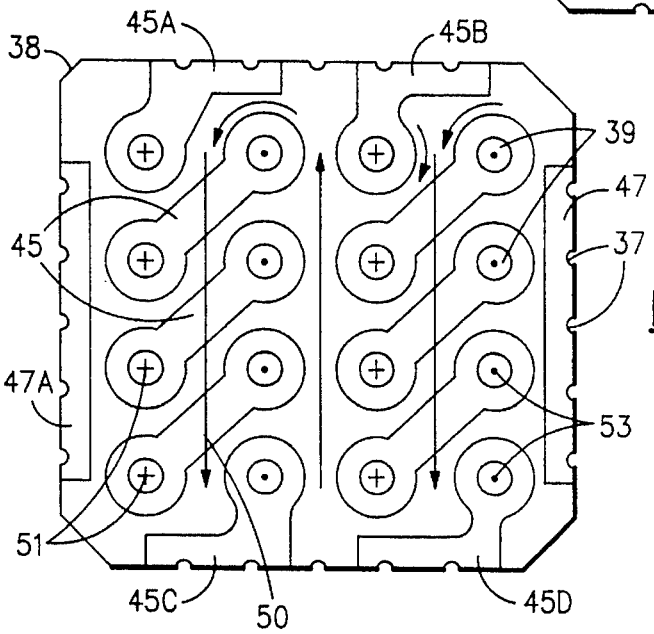
FIGS. 6C and 6D are plan views of the bottom and top side, respectively, of FIGS. 5A and 5B covered with a layer of dielectric material and a second pattern of conductive material on each side, for forming a sixteen element magnetic device in accordance with the present invention.
Figure 6D:
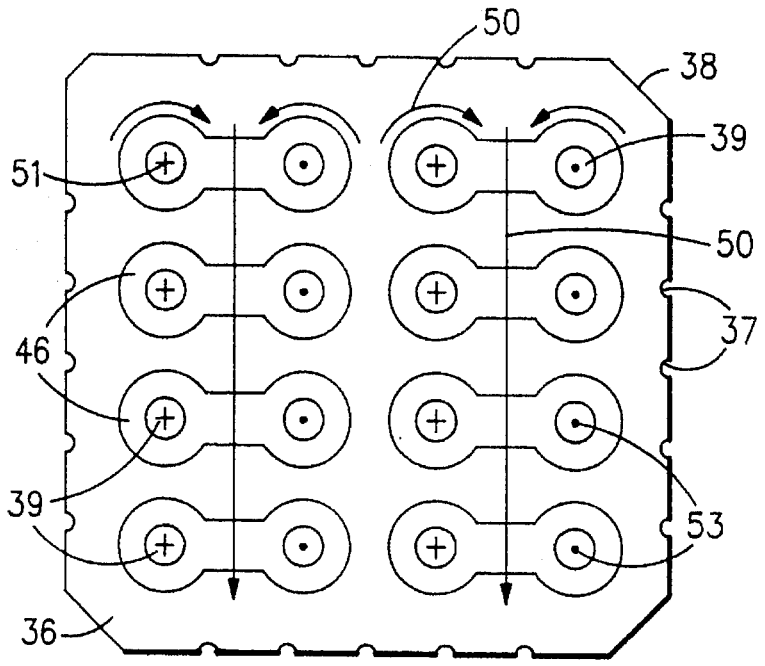

A second layer of electrical current conductive material, such as copper is plated on the bottom and top of the insulating material including the vias, with the second layer of plating in the vias forming the transformer element secondary as shown in FIGS. 6C and 6D. Note the location of the indexing corner 38 in determining the relative orientation of FIGS. 6C and 6D. The pattern of conductive material on the bottom of the plate 45 again surrounds the holes and together with the pattern 46 on the top of the plate providing two groups of eight, series connected elements. The pattern on the bottom of the ferrite plate brings out four termination regions 45A, 45B, 45C, and 45D to the edge of the plate. The termination regions are connected to the first and last element of the first eight series connected elements and the first and last element of the second group of eight series connected elements. The four locations 45A, 45B, 45C, and 45D at the edge of the plate are not aligned with the interconnect regions 41A and 41B of the first conductive layer and the four locations form a termination region for connecting, by means of solder, the leadless chip carrier shaped ferrite plate to a circuit card. Termination regions 47A and 47B are provided, which are aligned with the interconnect regions 41A and 41B of the first layer of conductive material. The region can be connected using solder on the edge of the ferrite.

Figure 7:
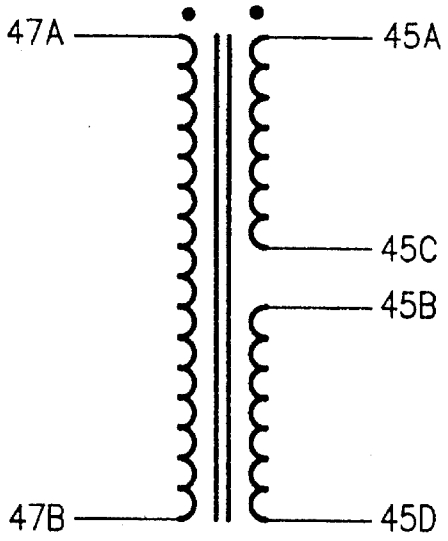
FIG. 7 is a schematic diagram of the magnetic device of FIG. 6.

Referring now to the schematic circuit diagram of FIG.7, when termination region 45A is connected to termination region 45B and termination region 45C is connected to termination region 45D, the two series connected eight element secondaries are connected in parallel with one another and a transformer with a two to one turns ratio can be achieved. Alternatively, a transformer with a turns ratio of one to one can be achieved by connecting the two eight element secondaries in series, with region 45C and 45B connected together.

The flux pattern in the permeable material can be controlled by the placement and interconnection of the transformer elements. The pattern shown, for example, between terminals 45A and 45C forms a coil similar to a conventional wire wound transformer. The lines of flux created by current flow in individual transformer elements can reinforce one another to enhance flux density. Arrows 50 indicate flux direction based on the direction of assumed current flow. Symbols 51 and 53 represent arrow heads and arrow tails, respectively, which indicate the direction of current flow, with arrow heads 51 indicating current flow out of the plane of the paper and arrow tails 53 indicating current flow into the plane of the paper.

When more of the elements are accessible external to the device, connections made on the circuit card, to which the magnetic device is surface mounted, can be used to achieve many turn ratio combinations depending on the series-parallel combinations of the elements. For example, by connecting N elements'primaries in series and N elements secondaries'in parallel, a transformer with an N to 1 ratio will be provided.

While the magnetic device has been described with the elements'primaries interconnected on the first copper layer and the elements'secondaries interconnected on the second copper layer, with some of the transformers interconnections provided by the next higher assembly through the power supplies circuit card, the primaries can alternatively serve as secondaries and the secondaries serve as primaries, to achieve additional turns ratio combinations. This allows the same group of multiple element transformers in a magnetic device to provide different turn ratio combinations as selected by the circuit card traces. More than two single turn windings can be provided in the holes or on the edges by adding another insulating layer followed by another layer of conductive plating. The hole size will have to be enlarged to accommodate additional windings. The connections of the magnetic device to the next higher assembly can be accomplished using the surface mounting techniques described or by other means including wire bond methods or discrete soldered wires to any surface, including top planar surface. Termination regions can be provided at the top or bottom and distributed over the top and bottom surfaces.

While the invention has been particularly shown and described with reference to preferred embodiments thereof, it will be understood by those skilled in the art that the foregoing and other changes in form and detail may be made therein without departing from the spirit and scope of the invention.

What is claimed is:

1. A method of making a magnetic device for surface mounting on a circuit board comprising the steps of:

forming a plurality of holes through a plate of flux permeable material;

plating a first layer of current conductive material in the holes to form a plurality of first windings passing therethrough, such that each of the holes is disposed about only a single one of the plurality of first windings passing therethrough;

plating on both sides of the plate to interconnect at least a portion of the plurality of first windings;

plating regions on the plate, each of the regions connected to at least a portion of the first windings, for use in surface mounting of the magnetic device;

covering the first layer of current conductive material with an insulating layer; and plating a second layer of current conductive material in the holes on the insulating layer to form a plurality of second windings passing therethrough, such that each of the holes is disposed about only a single one of the plurality of second windings passing therethrough;

plating on both sides of the plate to interconnect at least a portion of the plurality of second windings; and plating regions on the plate, each of the regions connected to at least a portion of the second windings, for use in surface mounting the magnetic device.

2. The method of claim 1 wherein said regions are located on one side of said plate.

3. The method of claim 1 wherein said regions are located at the edge of the plate.

4. The method of claim 1 further comprising the step of using solder to attach said magnetic device to a circuit card.

5. The method according to claim 1, wherein the plate of flux permeable material comprises ferrite.

6. The method according to claim 1, wherein the plating steps utilize copper as a plating material.

7. The method according to claim 1, wherein the insulating layer comprises parylene thermoplastic polymer.

* * * * *